US008869481B2

(12) United States Patent
Dzigava

(10) Patent No.: US 8,869,481 B2
(45) Date of Patent: Oct. 28, 2014

(54) FLOORING DEVICES, SYSTEMS, AND METHODS THEREOF

(76) Inventor: Paata Dzigava, Brooklyn, NY (US)

( * ) Notice: Subject to any disclaimer, the term of this patent is extended or adjusted under 35 U.S.C. 154(b) by 25 days.

(21) Appl. No.: 12/826,792

(22) Filed: Jun. 30, 2010

(65) Prior Publication Data

US 2011/0203213 A1 Aug. 25, 2011

Related U.S. Application Data

(60) Provisional application No. 61/306,402, filed on Feb. 19, 2010.

(51) Int. Cl.

| | |
|---|---|
| ***E04F 15/00*** | (2006.01) |
| ***E04B 2/00*** | (2006.01) |
| ***B44C 5/04*** | (2006.01) |
| ***E04F 15/04*** | (2006.01) |
| ***B44C 1/28*** | (2006.01) |

(52) U.S. Cl.

CPC ..... *E04F 15/04* (2013.01); *E04F 2201/0107* (2013.01); *B44C 5/04* (2013.01); *E04F 2201/0511* (2013.01); *B44C 1/28* (2013.01)

USPC ..... 52/311.2; 52/588.1

(58) Field of Classification Search

CPC ..... E04F 15/02; E04F 15/02038; E04F 15/04; E04F 15/048; E04F 13/0871; E04F 2015/02; E04F 2201/0107; E04F 2203/02

USPC ..... 52/483.1, 489.1, 578, 581, 588.1, 52/582.1, 586.1, 586.2, 585.1, 589.1, 52/590.2, 311.1, 311.2

See application file for complete search history.

(56) References Cited

U.S. PATENT DOCUMENTS

| | | | | | |
|---|---|---|---|---|---|
| 615,832 | A | * | 12/1898 | Fields, Jr. | 52/590.2 |
| 675,344 | A | * | 5/1901 | Bates | 52/311.2 |
| 687,086 | A | * | 11/1901 | Upham | 15/238 |
| 1,660,480 | A | * | 2/1928 | Ernest | 52/390 |
| 1,756,583 | A | * | 4/1930 | Cadwallader | 52/396.04 |
| 2,014,841 | A | | 9/1935 | Heeren et al. | |
| 2,027,292 | A | * | 1/1936 | Rockwell | 52/396.1 |
| 2,049,571 | A | * | 8/1936 | Schuck | 52/586.1 |
| 2,054,015 | A | | 9/1936 | Bruce et al. | |
| 3,740,913 | A | | 6/1973 | Musser | |
| 4,133,152 | A | | 1/1979 | Penrose | |
| 4,620,998 | A | * | 11/1986 | Lalvani | 428/33 |
| 5,050,653 | A | * | 9/1991 | Brown | 144/351 |
| 5,466,089 | A | | 11/1995 | Jurik | |
| 5,813,186 | A | | 9/1998 | Acksel | |

(Continued)

FOREIGN PATENT DOCUMENTS

| | | |
|---|---|---|
| JP | 2006241727 | 9/2006 |

*Primary Examiner* — Ryan Kwiecinski

(74) *Attorney, Agent, or Firm* — Amster, Rothstein & Ebenstein LLP

(57) ABSTRACT

A flooring system including at least two sets of flooring panels. A first set of flooring panels having a first shape and recessed grooves on the opposite lateral sides. The first set of panels being constructed from a plurality of wood elements adhesively affixed together. A second set of flooring panels having a second shape and an integral tongue protruding from the opposite lateral sides. The second set of panels being constructed at least one wood element. The first set of panels and second set of panels are connected by mating the tongue and groove. The resulting connection between the panels forming a floor with substantially flush upper surface.

25 Claims, 30 Drawing Sheets

(56) References Cited

U.S. PATENT DOCUMENTS

| | | | | |
|---|---|---|---|---|
| 5,834,081 | A | 11/1998 | Fanti | |
| 6,189,283 | B1 | 2/2001 | Bentley | |
| 6,446,405 | B1 | 9/2002 | Pervan | |
| 6,460,303 | B1 * | 10/2002 | Pacione | 52/311.2 |
| 6,584,747 | B2 | 7/2003 | Kettler | |
| 6,659,097 | B1 * | 12/2003 | Houston | 125/12 |
| 6,925,764 | B2 | 8/2005 | Hrovath | |
| 7,021,304 | B1 | 4/2006 | Houston | |
| 7,021,346 | B2 * | 4/2006 | Chang | 144/333 |
| 7,275,350 | B2 * | 10/2007 | Pervan et al. | 52/592.1 |
| 7,552,568 | B2 | 6/2009 | Palsson | |
| 7,877,956 | B2 * | 2/2011 | Martensson | 52/747.1 |
| 2001/0015042 | A1 * | 8/2001 | Ballard | 52/589.1 |
| 2001/0033771 | A1 | 10/2001 | Schmitz | |
| 2003/0021936 | A1 * | 1/2003 | Baldwin | 428/49 |
| 2004/0206038 | A1 * | 10/2004 | Stanchfield | 52/582.1 |
| 2005/0097860 | A1 * | 5/2005 | Martensson | 52/782.1 |
| 2006/0032168 | A1 | 2/2006 | Thiers | |
| 2007/0175143 | A1 | 8/2007 | Pervan | |
| 2008/0041007 | A1 | 2/2008 | Pervan | |
| 2009/0260307 | A1 * | 10/2009 | Thiers | 52/309.1 |
| 2010/0212245 | A1 * | 8/2010 | Tebo | 52/393 |

* cited by examiner

FIG. 8F
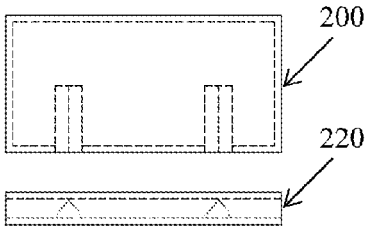
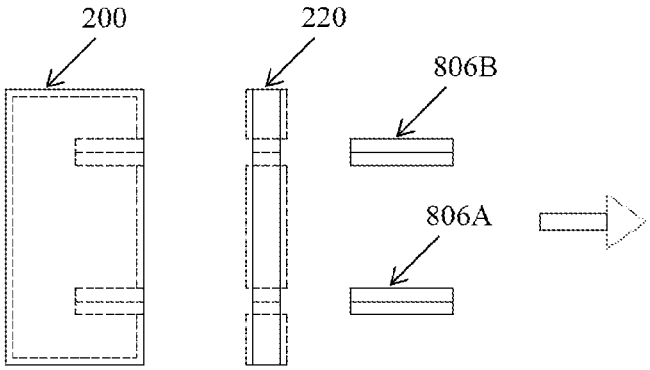
FIG. 8G
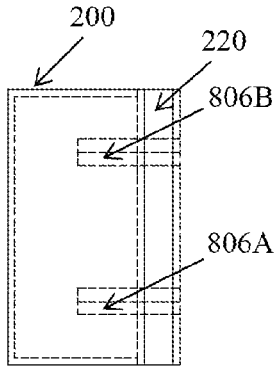
FIG. 8H

FIG. 8I
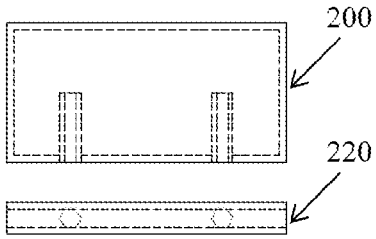
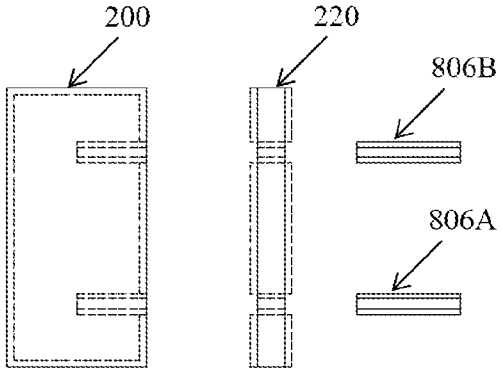
FIG. 8J
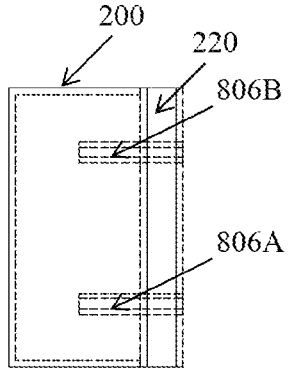
FIG. 8K 200
220

202
204
210
900
200

202
210
204
200
900
230
222
224
220

FLOORING DEVICES, SYSTEMS, AND METHODS THEREOF

CROSS-REFERENCE TO RELATED APPLICATIONS

This application claims priority to U.S. Provisional Patent Application No. 61/306,402, filed Feb. 19, 2010, the content of which is incorporated herein by reference in its entirety.

FIELD OF THE INVENTION

The present invention relates to a flooring system for creating a floor having a substantially flush upper surface constructed of at least two sets of flooring panels.

SUMMARY OF THE INVENTION

In exemplary embodiments, a flooring system can comprise a set of first flooring panels that can have a first shape including a top surface, a bottom surface, and at least two lateral sides. Each of the first flooring panels can include at least one groove extending at least partially the length of the at least two lateral sides, and each of the first flooring panels can be constructed from a plurality of substantially monolithic solid wood elements adhesively affixed together. The flooring system can further comprise a set of second flooring panels that can have a second shape including a top surface, a bottom surface, and at least two lateral sides. Each of the second flooring panels can include at least one tongue extending at least partially the length of the at least two lateral sides, and each of the second flooring panels can be constructed of substantially monolithic solid wood element. Further, the first flooring panels and the second flooring panels can be connected such that the tongues of the second flooring panels can be inserted into the grooves of the first flooring panels, and the resulting connection between the flooring panels can form a floor with substantially flush upper surface.

In exemplary embodiments, the groove of the first flooring panels can at least partially extend on three lateral sides of the first flooring panels and the tongue of the second flooring panels can at least partially extend on three lateral sides of the second flooring panels.

In exemplary embodiments, the groove of the first flooring panels can at least partially extend on all lateral sides of first flooring panels and the tongue of the second flooring panels can at least partially extend on all lateral sides of the second flooring panels.

In exemplary embodiments, the first and second flooring panels can have generally different geometric shapes.

In exemplary embodiments, the first flooring panels can comprise a plurality of pieces of material forming a decorative design on the upper surface of the floor.

In exemplary embodiments, the flooring system can further comprise a protective insert shaped to correspond to the contour of the groove of the first flooring panels, the insert can be located in the groove of the first flooring panels.

In exemplary embodiments, the insert can include a guide capable of having at least one nail and/or staple placed through a lower region of the groove of the first flooring panels and into a base structure.

In exemplary embodiments, the guide may be oriented at about a 45 degree angle from vertical. Further, the insert can include a guide capable of can have at least one nail and/or staple placed through it and into a base structure.

In exemplary embodiments, the tongue of second flooring panels can discontinuously extend at least partially the length of at least one lateral side of the second flooring panels such that the length of the lateral side can include at least one tongued region and at least one non-tongued region.

In exemplary embodiments, the flooring system can further comprise an insert that can have a non-tongued region shaped to the contour of the non-tongued region of the second flooring panels and a tongued region.

In exemplary embodiments, the non-tongued region of the insert can include a sloped surface and the non-tongued region of the second flooring panels can include a similarly sloped surface.

In exemplary embodiments, the tongue region of the insert can be capable of being inserted into the groove of the first flooring panels and can be capable of receiving an at least one nail and/or staple such that the insert can be substantially affixed to a base structure.

In exemplary embodiments, the insert can be capable of receiving the at least one nail and/or staple such that the nail and/or staple passes through the insert, through a region of the groove of the first flooring panel, and into the base structure.

In exemplary embodiments, the insert can be capable of receiving the at least one nail and/or staple such that the nail and/or staple passes through the insert and into the base structure.

In exemplary embodiments, when the insert is affixed to the base structure the non-tongued region of the second flooring panel can be capable of being mated with the non-tongued region of the insert.

In exemplary embodiments, the flooring system can further comprise a retention element that can substantially maintain the flooring panels flush upper surface. The first flooring panels can include at least one retention element receiving opening, the retention element receiving opening can be on at least one lateral side of the first flooring panel creating an opening extending a predetermined depth into the body the first floor panel. Further, the second flooring panels can include at least one retention element receiving opening located at the tongued region and/or the non-tongued region of the second flooring panel, the retention element receiving opening can extend from one lateral side to the other lateral side of the second flooring panel creating a retention element receiving opening extending through the body of the second flooring panel. Even further, the retention element may be inserted into the receiving opening in the first flooring panel and placed through the first flooring panel and inserted into the receiving opening in the second flooring panel and inserted at least partially into the second flooring panel, and the retention element can remain in both the first and second flooring panels.

In exemplary embodiments, the retention element can remain in both the first and second flooring panels and a region of the retention element can remain substantially flush with tongue of the second flooring panel.

In exemplary embodiments, the retention element can further comprise a first end, a second end, a substantially monolithic body connecting the first end to the second end, and the monolithic body can have an external surface.

In exemplary embodiments, the external surface of the retention element may be substantially smooth and/or contain a geometric shape designed to mate with the receiving opening in the first and second floor panels.

In exemplary embodiments, the first and second end of the retention element can be substantially triangular, square, polygonal, hexagonal, star shaped, circular, oval, and/or rectangular.

In exemplary embodiments, the height of the retention element can be substantially similar to the height of the tongue of the second flooring panels and the retention element can include a substantially flat upper and lower surface.

BRIEF DESCRIPTION OF THE DRAWINGS

The features and advantages of the present invention will be more fully understood with reference to the following, detailed description of an illustrative embodiment of the present invention when taken in conjunction with the accompanying figures, wherein:

FIGS. 8D-8K illustratively depict the first and second flooring panel including a retention element of the system and method of the present invention;

DETAILED DESCRIPTION OF THE EXEMPLARY EMBODIMENTS

Figure 1A:
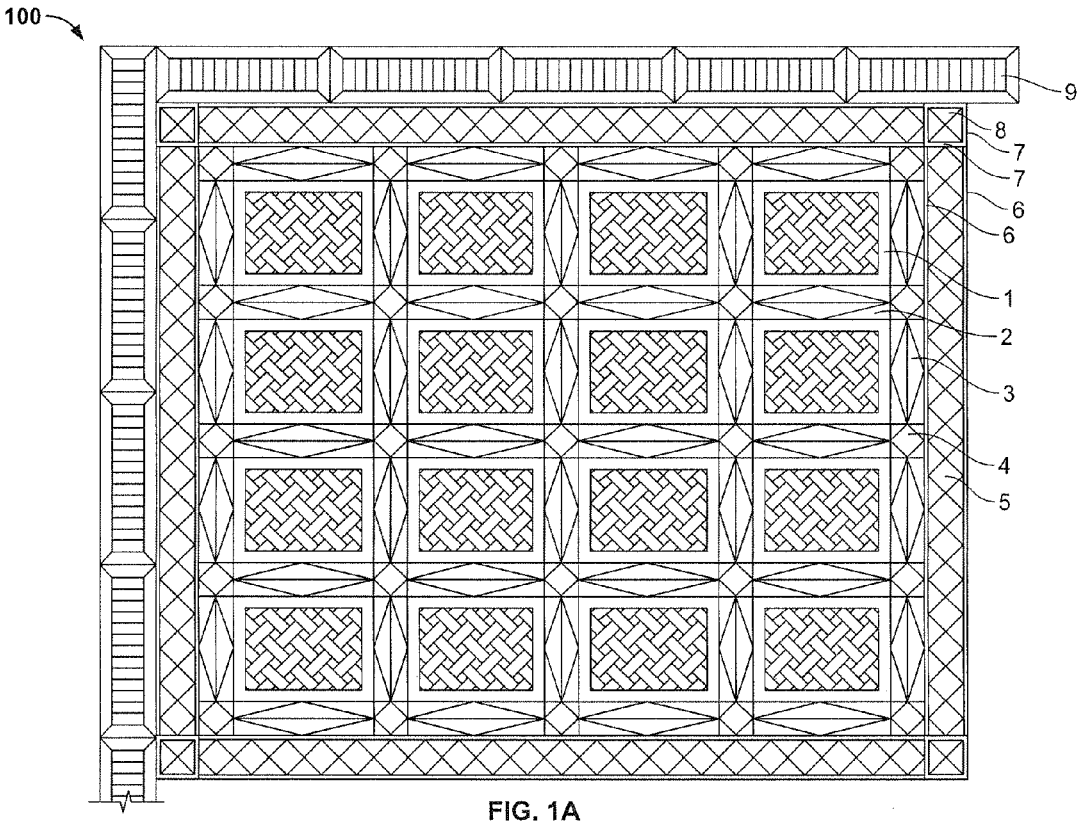
FIGS. 1A-1J illustratively depict a floor constructed of at least a first style flooring panel and a second style flooring panel of the system and method of the present invention.
Figure 1B:
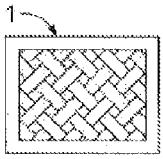
Figure 1C:
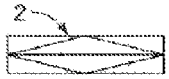

Referring to FIGS. 1A-1J, in accordance with an exemplary embodiment, a floor 100 can be constructed of a plurality of flooring panels having a first shape and a plurality of flooring panels having a second shape different from the first shape. For example, a quantity of substantially square shaped flooring panels and a quantity of substantially rectangular shaped flooring panels can be combined creating a solid hardwood floor. As a further example, floor 100 can be constructed of any reasonable plurality of various shaped flooring panels such as, for example, flooring panel 1, flooring panel 2, flooring panel 3, flooring panel 4, flooring panel 5, flooring panel 6, flooring panel 7, flooring panel 8, and/or flooring panel 9.

In accordance with an exemplary embodiment, some of the flooring panels can include a geometric pattern that can be created by inlaying a plurality of elements. In accordance with an exemplary embodiment, geometric pattern can be a component of the flooring panel. The combination of these geometric patterns, alone or in combination with the differing styles of flooring panels, as well as the construction of the panels, can create a floor including desirable pattern (e.g., a decorative design).

In accordance with an exemplary embodiment, the construction of these flooring panels can be combined to create, for example, a substantially flush floor having substantially less visible seams that can be caused by the abutment of at least two lateral surfaces (e.g., the lateral surfaces of a first and second flooring panels, the lateral surfaces of at least two elements in a panel, etc.).

Referring to FIGS. 2A-2K, in accordance with an exemplary embodiment, a first flooring panel 200 having a first shape can include a top surface 202, a bottom surface 204, and at least one lateral side 206 (e.g., 206A, 206B, 206C, 206D). Further, in accordance with an exemplary embodiment, first flooring panel 200 can include a geometric pattern. As shown, the sides of first flooring panel 200 can include a female receiving region 210 on at least one lateral side 206 (e.g., 206A, 206B, 206C, 206D). In accordance with an exemplary embodiment, female receiving region 210 can be located on any number of lateral sides 206. Further, although not depicted, first flooring panel 200 can include any number of lateral sides. For example, viewing first flooring panel 200 from top surface 202, first flooring panel 200 can be, for example, square, polygonal, triangular, circular, ovoid, star shaped, or any other reasonable geometric shape.

Still referring to FIG. 2, in accordance with an exemplary embodiment, a second flooring panel, 220 having a second shape different than first flooring panel 200, can include a top surface 222, a bottom surface 224, and at least one lateral side 226 (e.g., 226A, 226B, 226C, 226D). In accordance with an exemplary embodiment, the sides of second flooring panel 220 can include a male protrusion 230 on at least one lateral side 226 (e.g., 226A, 226B, 226C, 226D). In accordance with an exemplary embodiment, male protrusion 230 can be located on any number of lateral sides. Further, although not depicted, second flooring panel 220 can include any number of lateral sides. For example, viewing second flooring panel 220 from top surface 222, second flooring panel 220 can be, for example, square, polygonal, triangular, circular, ovoid, star shaped, or any other reasonable geometric shape.

In accordance with an exemplary embodiment, first flooring panel 200 and second flooring panel 220 can be joined together (e.g., mated) such that female receiving region 210 receives male protrusion 230. Female receiving region 210 can be, for example, a groove, a slot, female dovetail, or any other reasonable female interlocking joint. Male protrusion 230 can be, for example, a tongue, a ridge, a rib, collared protrusion, or any other reasonable male interlocking joint. Although not shown, first flooring panel 200 and second flooring panel 220 can be joined by any reasonable method such as, but not limited to, a butt joint, a mitre joint, a spline joint, a half lap joint, a dove-tail joint, a the mortise and tenon joint, or any other reasonable method. For ease, first flooring panel 200 and second flooring panel 220 are illustratively depicted as joining by male protrusion and female receiving region, this is in no way meant to be a limitation.

In accordance with an exemplary embodiment, first flooring panel 200 and second flooring panel 220 can both include any of at least one male protrusion and female receiving region, only male protrusions or female receiving regions, a combination of both male protrusions and female receiving regions, or any other reasonable combination thereof. For example, first flooring panel 200 can include at least one male protrusion, only male protrusions, at least one female receiving region, only female receiving regions, a combination of both male protrusions and female receiving regions, or any other reasonable combination of female receiving regions and/or male protrusions. Similarly, second flooring panel 220 can include at least one male protrusion, only male protrusions, at least one female receiving region, only female receiving regions, a combination of both male protrusions and female receiving regions, or any other reasonable combination of female receiving regions and/or male protrusions.

In accordance with an exemplary embodiment, the size of the flooring panel can determine whether or not the panel has male protrusions and/or female receiving regions. For example, larger flooring panels can include only female receiving regions and smaller panels can have only male protrusions. For another example, larger panels can have only male protrusions and smaller panels can have only female receiving regions.

In accordance with an exemplary embodiment, the panel can include additional lateral sides that can include male protrusions and/or female receiving regions. For example, lateral side 226*b* of panel 220 can be divided into a plurality of lateral sides (not shown) such that lateral side 226*b* has a shape. This shape could, for example, have two lateral sides that bisect each other and each of these lateral sides can include can include male protrusions and/or female receiving regions. It will be understood that the flooring panels can include any plurality of lateral sides.

In accordance with an exemplary embodiment, both first flooring panel 200 and second flooring panel 220 can only include at least one female receiving region and be joined by a third male insert placed in one female receiving region in each of first flooring panel 200. For ease, first flooring panel 200 is illustratively depicted as only having female receiving region 210 and second flooring panel 220 is illustratively depicted as only having male protrusion 230, this is in no way meant to be a limitation.

In accordance with an exemplary embodiment, female receiving region 210 and male protrusion 230 can be produced by removing at least some wood from either the first flooring panel 200 or second flooring panel 220 from any lateral side of the panel and in some instances also from either, or both, of the top and bottom surfaces of the panel. Accordingly, female receiving region 210 and male protrusion 230 can be produced by having wood removed from either the first flooring 200 panel or second flooring panel 220 using a device such as, but not limited to, a four or six-head moulder, a spindle moulder, a circular saw bench, any suitable hand planes (e.g., a plough plane for the female receiving region, a tongue plane for the male protrusion, a combination plane, etc.), a spindle route, or any other reasonable wood removing device.

Figure 1D:
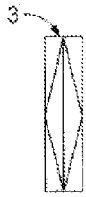
Figure 1E:
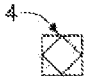
Figure 1F:
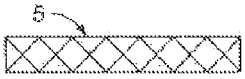
Figure 1G:
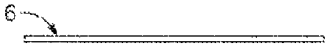
Figure 1H:
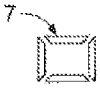
Figure 1I:
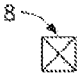
Figure 1J:
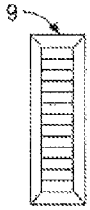
Figure 2A:
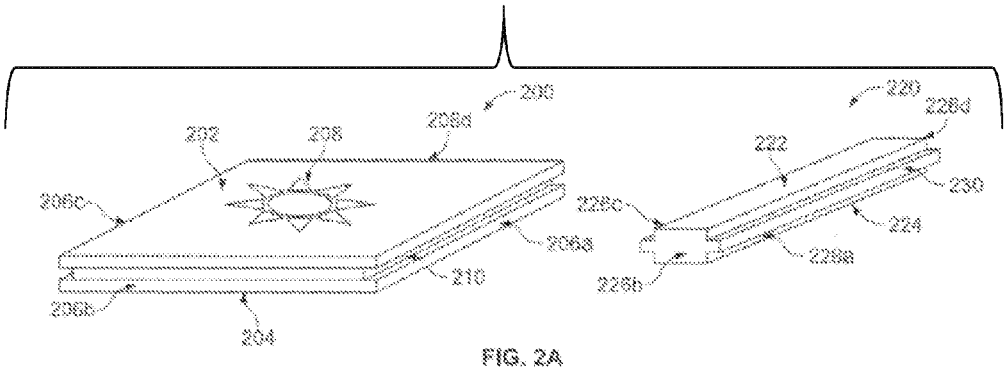
FIGS. 2A-2K illustratively depicts a first flooring panel and a second flooring panel of the system and method of the present invention.
Figure 2B:
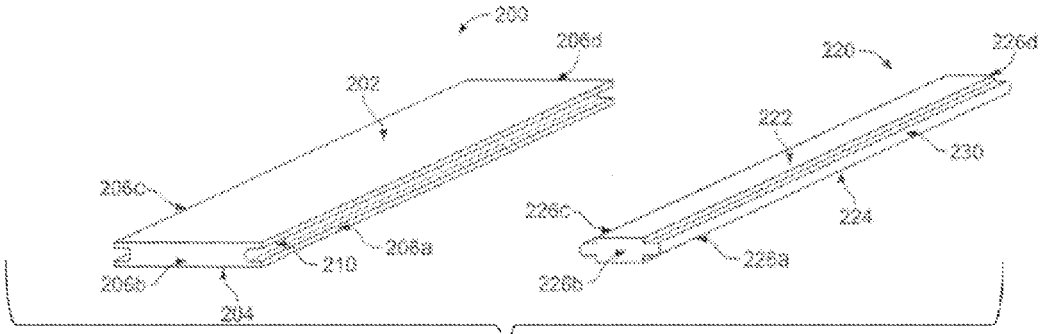
Figure 2C:
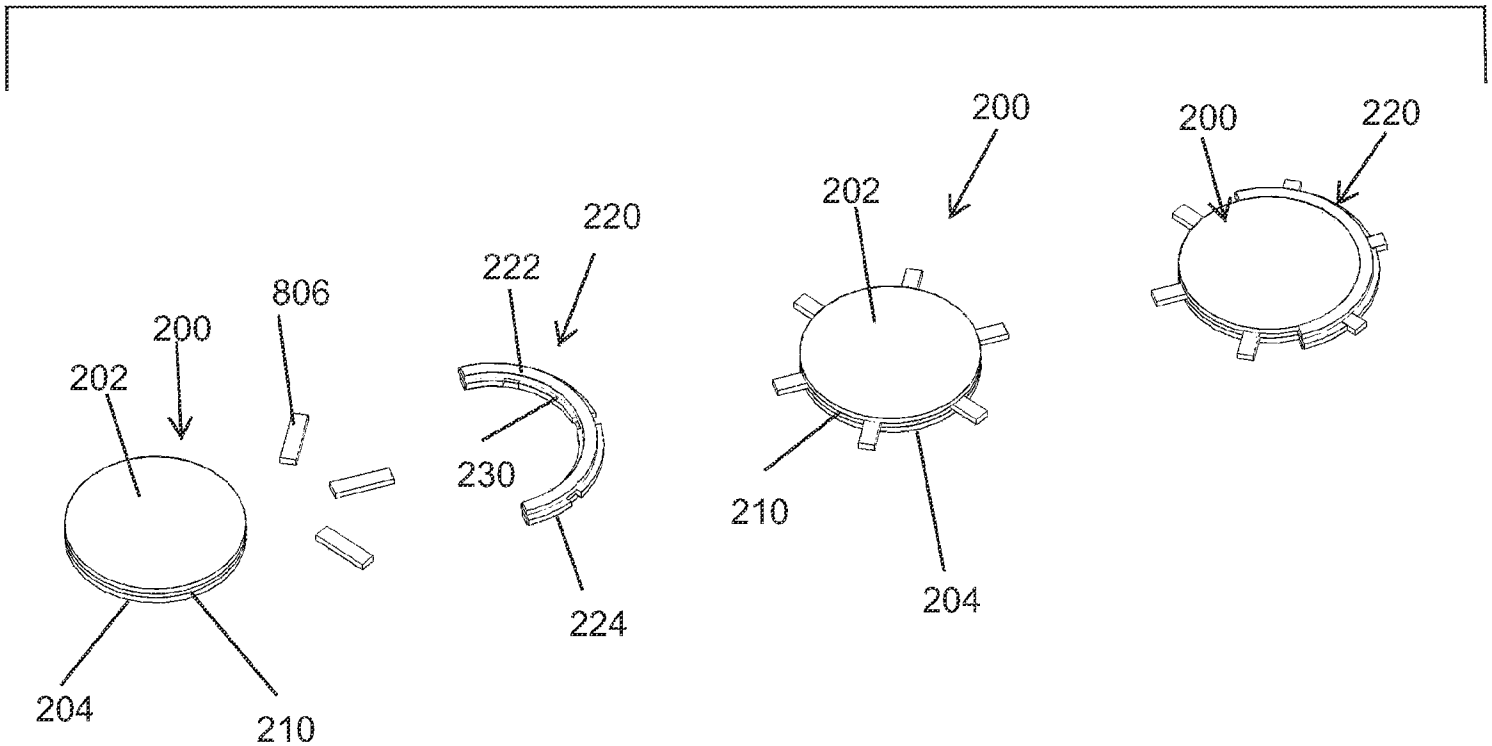
Figure 2D:
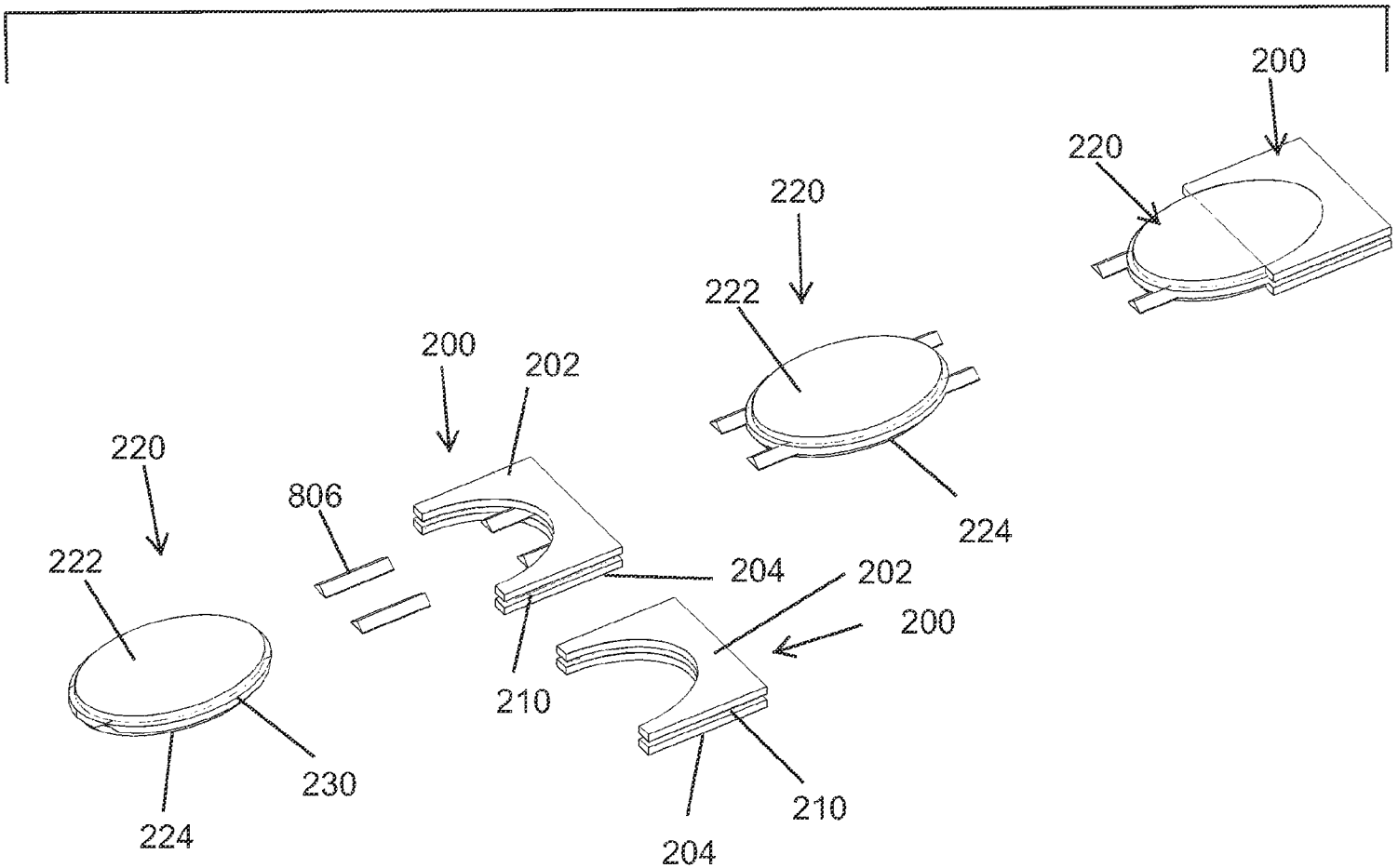
Figure 2E:
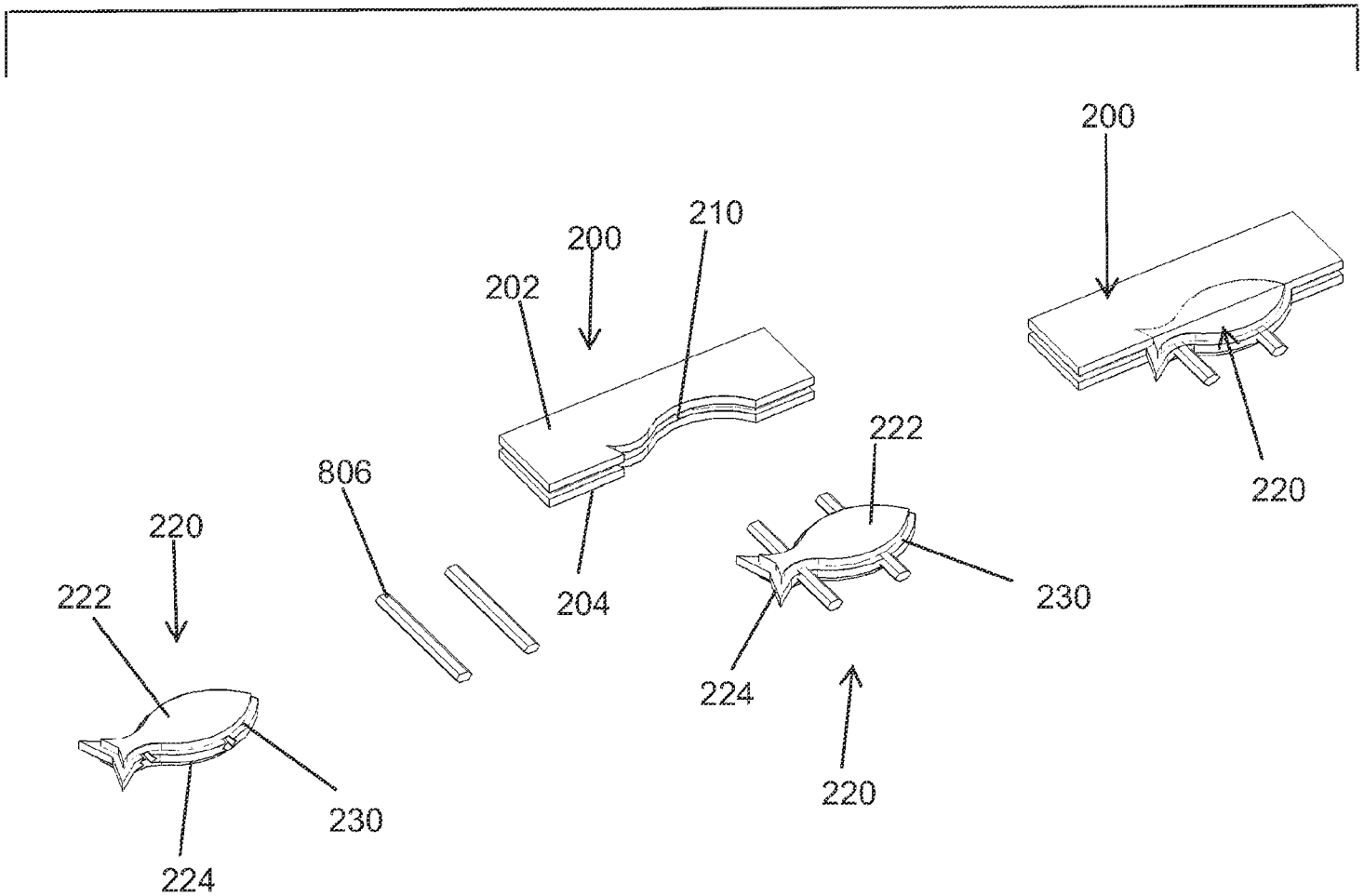
Figure 2H:
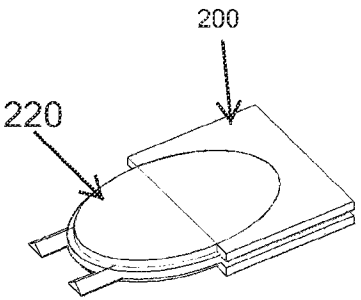
Figure 2G:
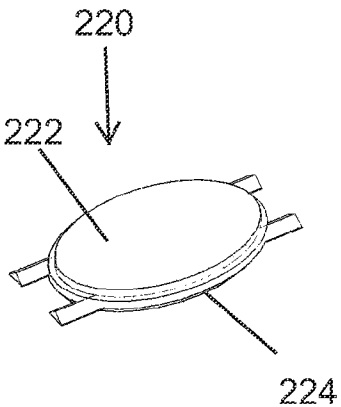
Figure 2F:
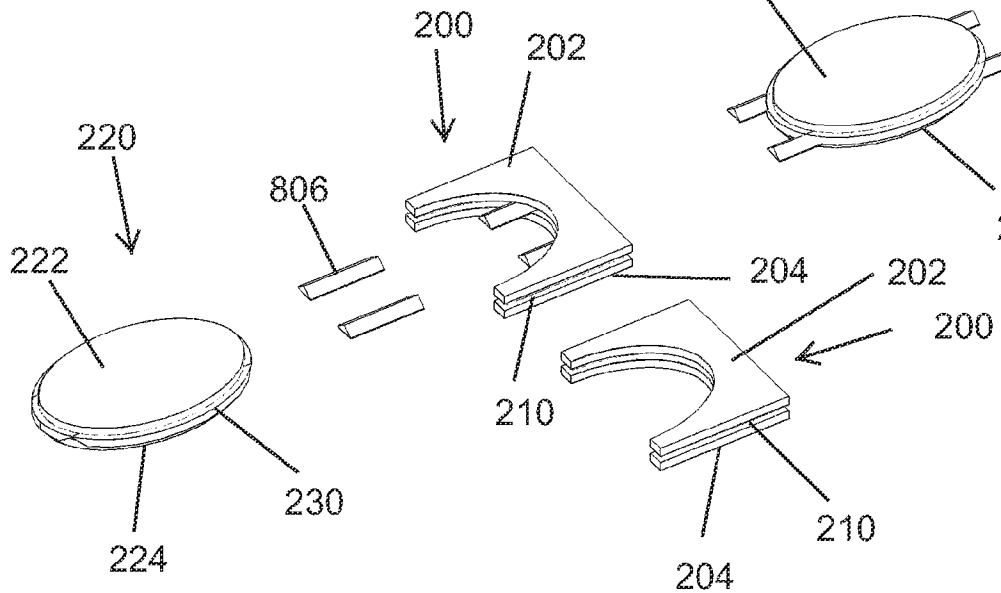
Figure 2K:
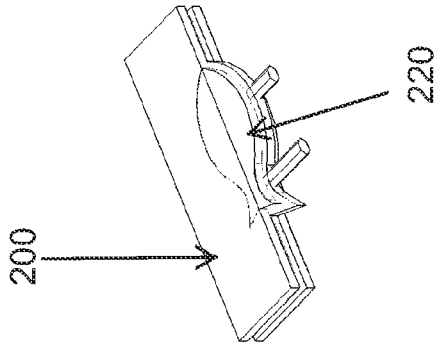
Figure 2J:
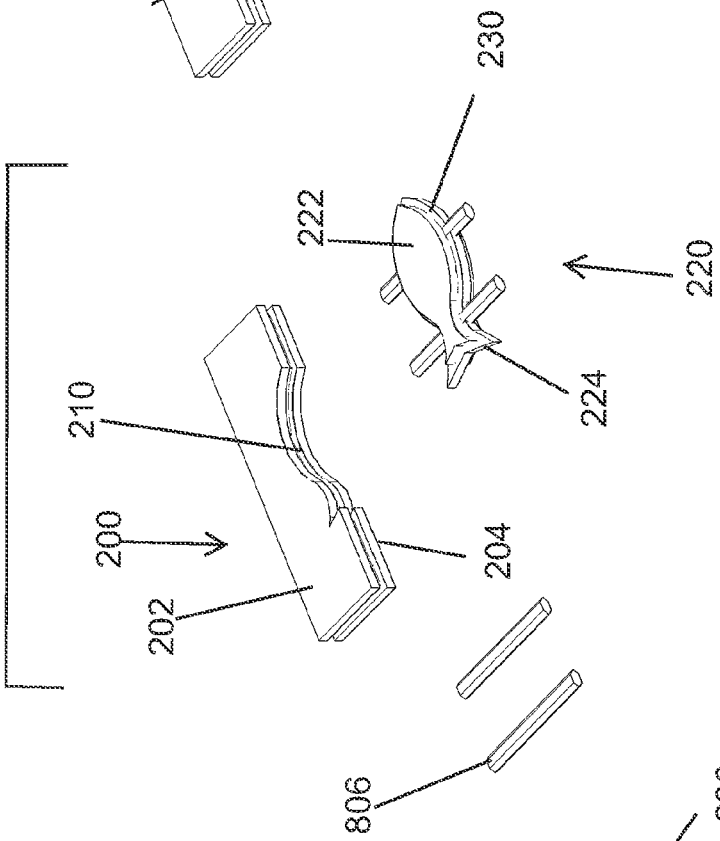
Figure 2I:
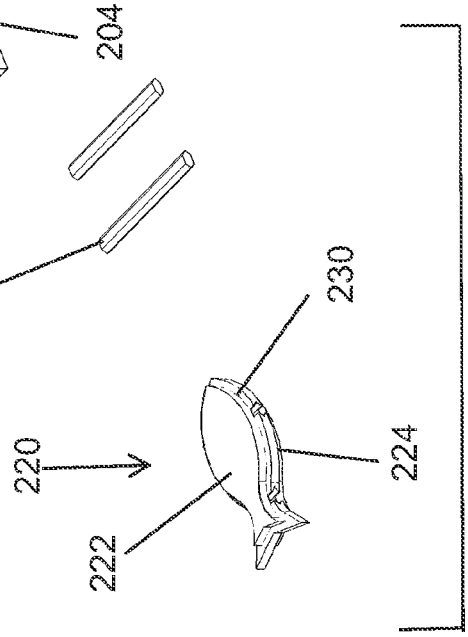
Figure 3A:
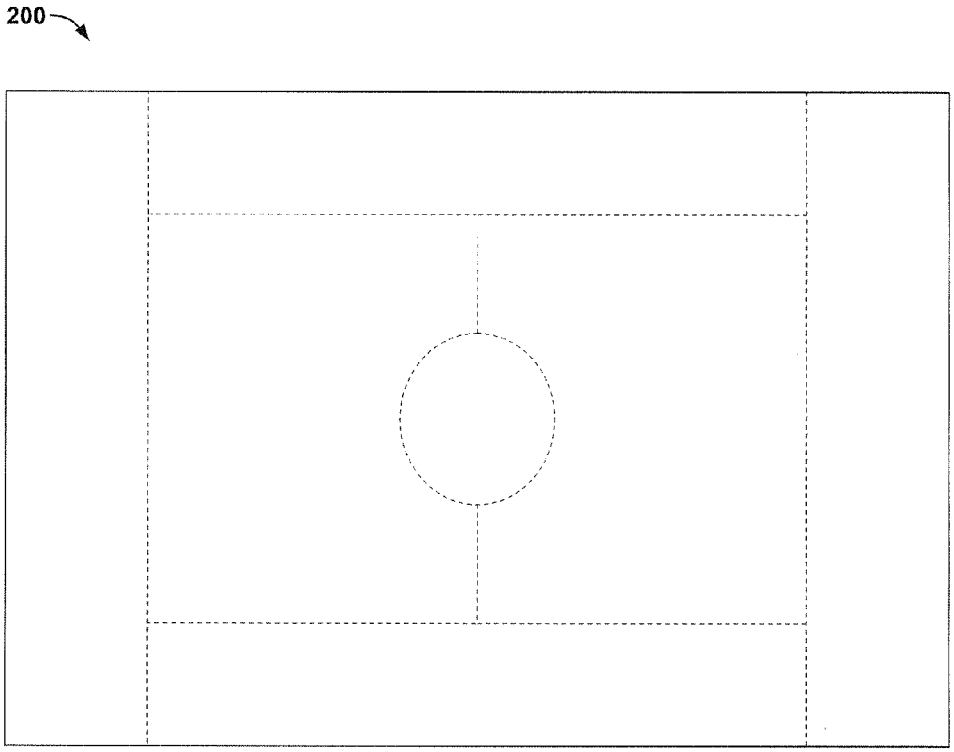
FIGS. 3A-C illustratively depict a first flooring panel constructed from a plurality of elements of the system and method of the present invention.
Figure 3B:
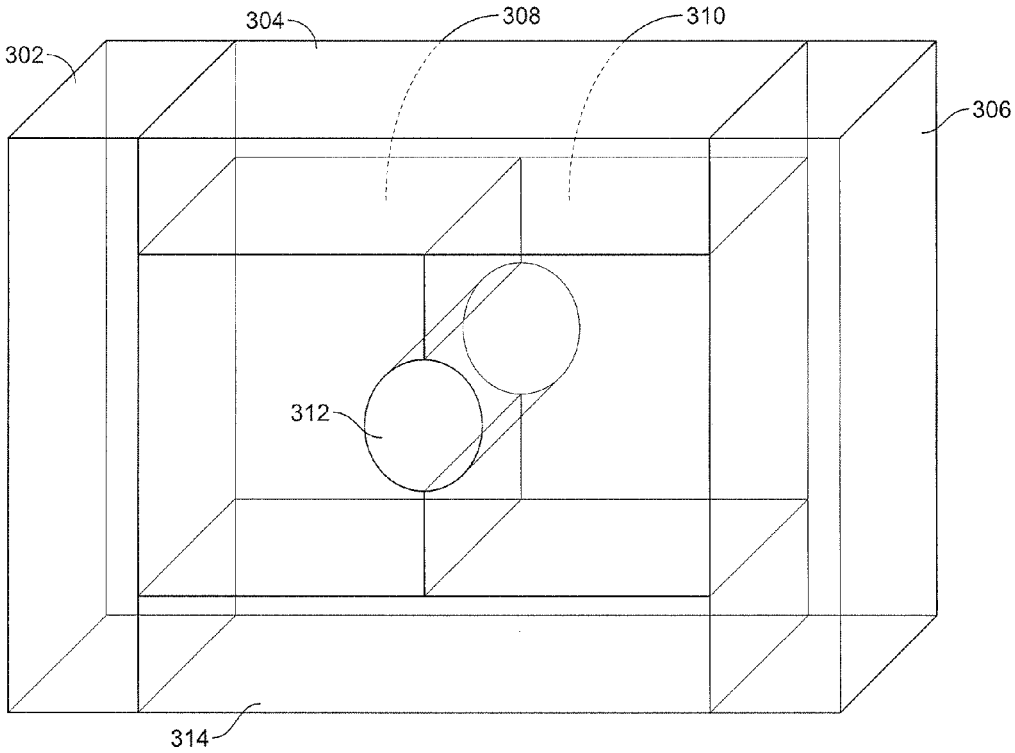
Figure 3C:
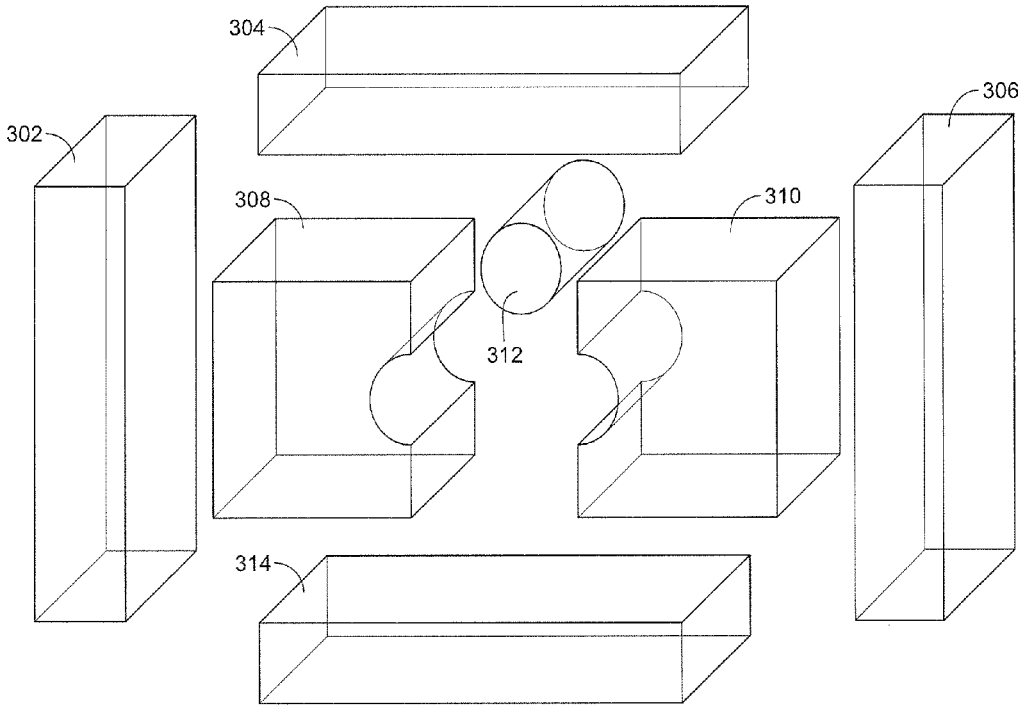

Referring to FIG. 3A-3C, in accordance with an exemplary embodiment, first and second flooring panels can be constructed of at least one substantially monolithic element. In accordance with an exemplary embodiment, the at least one substantially monolithic element can be wood. For ease, only first flooring panel 200 is depicted as being constructed from a plurality of substantially monolithic elements, however, second flooring panel 220 can be constructed similarly. For example, as shown in FIGS. 1B-1J, each of the flooring panels 1-9 that make up the floor 100 may be constructed of a plurality of substantially monolithic elements, so that even if some of the flooring panels have the same shape, the substantially monolithic elements that make up the same-shaped flooring panels may have shapes that differ from one another from panel to panel (for example, FIG. 1D shows a rectangular flooring panel made up of triangular-shaped monolithic elements, while FIG. 1J shows a rectangular flooring panel made up of rectangular-shaped and polygonal-shaped flooring panels).

Referring to FIG. 3A, in accordance with an exemplary embodiment, first flooring panel 200, viewed from the top, can appear to be a single wood panel. That is, viewed from the top, first flooring panel 200 does not, for example, appear to show seams (e.g., the abutment lateral surface of the elements illustratively depicted in phantom).

Referring to FIG. 3B, in accordance with an exemplary embodiment, first flooring panel 200 is depicted illustrating, for example, how a plurality of elements (e.g., 302, 304, 306, 308, 310, 312, and 314) can be combined (e.g., affixed) creating first panel 200.

Referring to FIG. 3C, in accordance with an exemplary embodiment, an exploded view of first panel 200 illustratively depicts, for example, how a plurality of elements (e.g., 302, 304, 306, 308, 310, 312, and 314) having varying shapes can be combined to construct first panel 200. In accordance with an exemplary embodiment, each of elements (e.g., 302, 304, 306, 308, 310, 312, and 314) can be a substantially monolithic material combined to create first panel 200. In accordance with an exemplary embodiment, each of elements (e.g., 302, 304, 306, 308, 310, 312, and 314) can include any plurality of lateral sides (e.g., one side for a circular columnar element, two sides for a ellipsoidal columnar element, three sides for a triangular columnar element, four sides for a polygonal columnar element, etc.).

In accordance with an exemplary embodiment, each of these lateral sides can be at least one of substantially smooth and include a geometric protrusion and/or recess (not shown). These geometric protrusions and/or recesses can be designed to mate with another geometric protrusion and/or recess located on another lateral side. Further still, as described below, each of these lateral sides can have an adhesive material placed on at least some region of them, for example, to affix each of the lateral sides together.

Figure 4A:
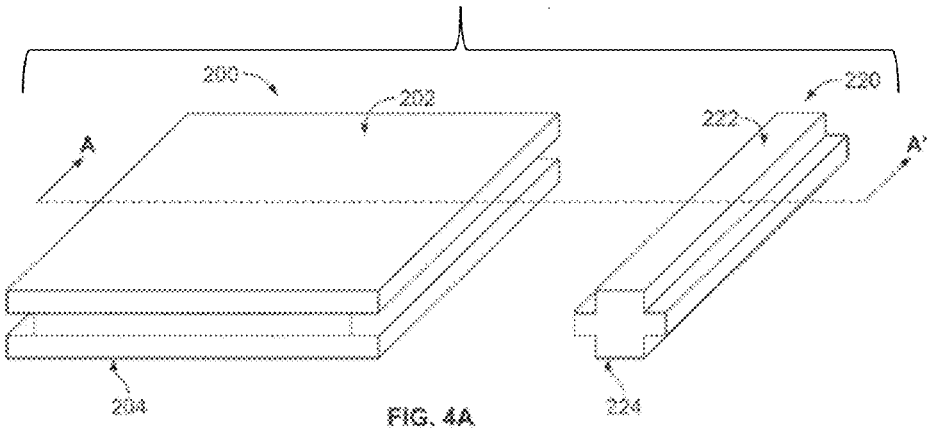
FIGS. 4A-4B illustratively depict the construction of the first and second flooring panel having at least one element extending from the top surface to the bottom surface of the system and method of the present invention.
Figure 4B:
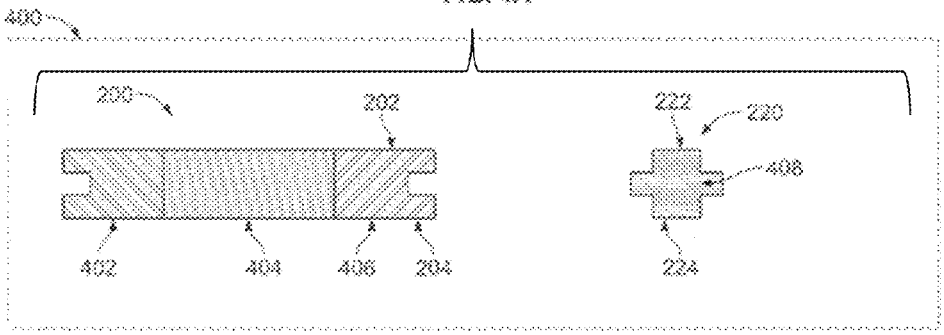

Referring to FIG. 4A-4B, in accordance with an exemplary embodiment, first flooring panel 200 and second flooring panel 220 are bisected by a plane 400 (e.g., corresponding with A and A') illustratively depicting the construction of first flooring panel 200 and second flooring panel 220 using at least one element extending from the top surface to the bottom surface of the respective panel. In accordance with an exemplary embodiment, when a plurality of elements are combined (e.g., creating a panel) they create a single top surface and bottom surface. This single top surface and single bottom surface can appear as a single top surface and a single bottom surface rather than a combination of each of the elements' top surfaces and bottom surfaces.

Referring to FIG. 4A, plane 400 (e.g., corresponding with A and A') bisects first flooring panel 200 in a region not containing geometric pattern 208. Referring to FIG. 4B, in accordance with an exemplary embodiment, as shown by bisecting first flooring panel 200 and second flooring panel 220, first flooring panel 200 can be constructed of a plurality of elements extending from top surface 202 to bottom surface 204 affixed together and second flooring panel 220 can be constructed of a single element extending from top surface 222 to bottom surface 224. For example, first flooring panel 200 can be constructed of first element 402, a second element 404, and a third element 406 each affixed together extending from top surface 202 to bottom surface 204. Further, second flooring panel 220 can be constructed of a single element 408 extending from top surface 222 to bottom surface 224.

Figure 5:
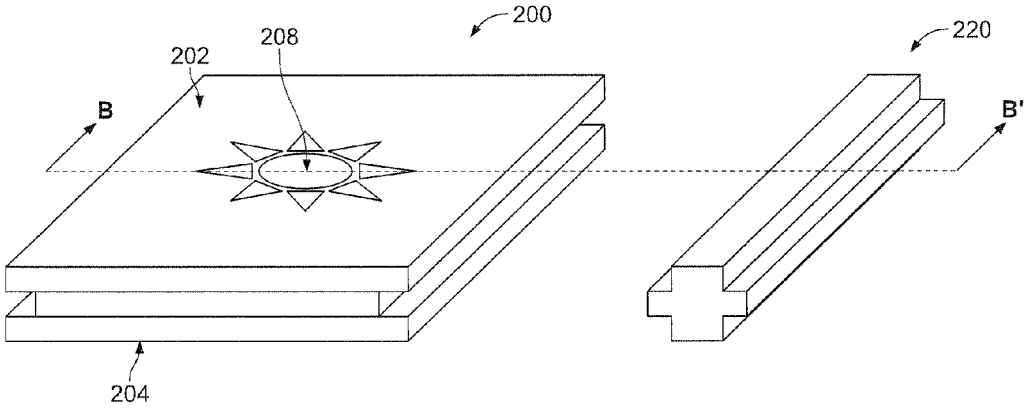
FIGS. 5-6 illustratively depict the construction of a geometric pattern in the first flooring panel having at least one element extending from the top surface to the bottom surface of the system and method of the present invention.
Figure 6:
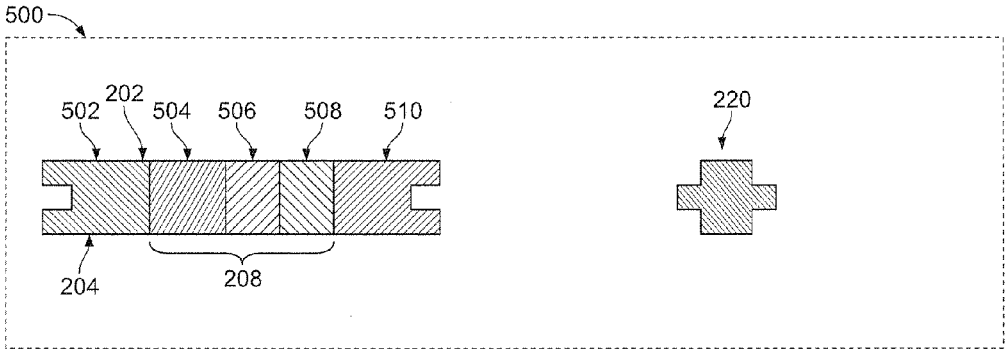

Referring to FIG. 5-6, in accordance with an exemplary embodiment, first flooring panel 200 and second flooring panel 220 are bisected by plane 500 (e.g., corresponding with B and B') illustratively depicting the construction of geometric pattern 208 using a plurality of elements extending from top surface 202 to bottom surface 204. Viewed from top surface 202, geometric pattern 208 can include any reasonable geometrical shape, such as, but not limited to squares, triangles, lozenges, herringbone or any other shape. In accordance with an exemplary embodiment, when a plurality of elements are combined (e.g., creating a panel with a geometric pattern) they create a single top surface and bottom surface.

Referring to FIG. 5, plane 500 (e.g., corresponding with B and B') bisects first flooring panel 200 in a region containing geometric pattern 208. Referring to FIG. 6, in accordance with an exemplary embodiment, as shown by bisecting first flooring panel 200 and geometric pattern 208, first flooring panel 200 and geometric pattern 208 can be constructed from a plurality of elements extending from top surface 202 to bottom surface 204. For example, first flooring panel 200 including geometric pattern 208 can be constructed of a first element 502, a second element 504, a third element 506, a fourth element 508, and a fifth element 510 each affixed together and each extending from top surface 202 to bottom surface 204. In accordance with an exemplary embodiment, any combination or number of elements can extend from top surface 202 to bottom surface 204 to create first flooring panel 200 including geometric pattern 208.

In accordance with an exemplary embodiment, flooring panels can be produced by cutting elements to a desired shape, patterning the elements, applying an adhesive to at least a region on at least one lateral side of at least one element, and applying pressure to at least one of the elements until the adhesive has substantially cured. Further, after patterning and applying an adhesive to at least one element, pressure can be applied to the top and/or bottom of the elements while pressure is applied on at least two lateral sides of the elements. Pressure can be applied to the top and/or bottom of the elements, at least one of before pressure is applied to at least two lateral sides of the elements or after pressure is applied to at least two lateral sides of the elements. In accordance with an exemplary embodiment, after patterning and applying an adhesive to at least one element, pressure can be applied on all lateral sides and top and bottom of the elements at about the same time.

In accordance with an exemplary embodiment, pressure can be applied to any lateral side, top surface, bottom surface, or any other desired areas by, for example, any reasonable form of vice or clamp such as, but not limited to a band clamp or web clamp, bar clamp, F-clamp, sliding clamp, bench clamp, cardellini clamp, jaw-style clamp, C-clamp (also G-clamp), flooring cramp, gripe, handscrew, kant-twist clamp, magnetic clamp, mitre clamp, pipe clamp, sash clamp, set screw, speed clamp, toggle clamp, pinch dog, woodworker's bench vise, engineer's bench vise, machine vise, woodworker's vise, hand vise (hand-held vise), machine vise, compound slide vise, cross vise, off-center vise, angle vise, sine vise, rotary vise, diemakers' vise, table vise, pin vise, jewelers' vise, and leg vise.

In accordance with an exemplary embodiment, the adhesive applied to at least a region on at least one lateral side of at least one element can be any reasonable adhesive such as, but not limited to, urea-formaldehyde, resorcinol, phenol formaldehyde resin, animal glues, polyvinyl acetate, polyurethane glue, epoxy, cyanoacrylate, contact cement, hot melt, hot bitumen, and cold adhesives. In accordance with an exemplary embodiment, the elements can be any reasonable wood such as, but not limited to, oak, walnut, cherry, lime, pine, maple, mahogany, bamboo (although technically a grass), and tropical woods.

In accordance with an exemplary embodiment, the elements can be cut to a desired shape can be cut by any reasonable device for cutting wood, such as, but not limited to, $CO_2$ laser, neodymium (Nd) laser, neodymium yttrium-aluminum-garnet (Nd—YAG) laser, or any other reasonable laser capable of cutting wood, hand saw, back saw, bow saw, circular saw, reciprocating saw, band saw, or any other reasonable saw capable of cutting wood, water jet cutter, air jet cutter, and steam jet cutter.

Figure 7:
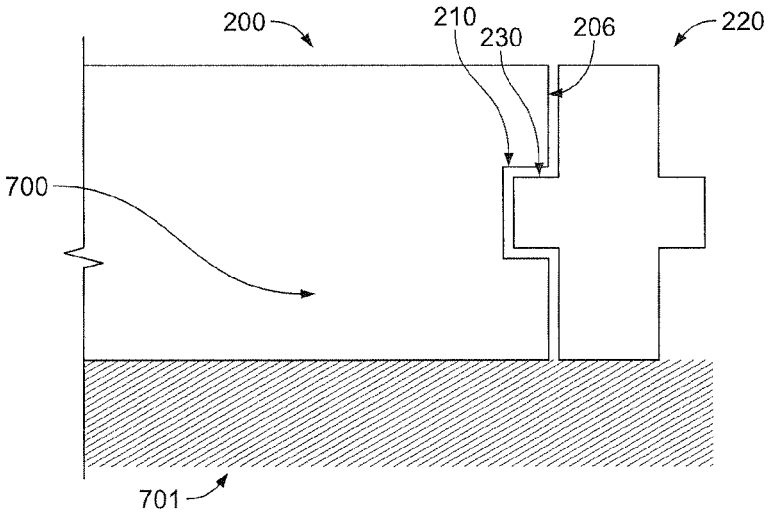
FIG. 7 illustratively depicts a bisected view of the first and second flooring panel while mated together of the system and method of the present invention.

Referring to FIG. 7, in accordance with an exemplary embodiment, first flooring panel 200 and second flooring panel 220 are illustratively depicted joined (e.g., mated) together. It will be understood that any gaps displayed in the drawing are only for illustrative purposes as first flooring panel 200 and second flooring panel 220 when joined can have negligible gaps. Further, a subfloor 701 is illustratively depicted under the flooring panel. When joined (e.g., mated), male protrusion 230 of second flooring panel 220 is located in female receiving region 210 of first flooring panel 200. In accordance with an exemplary embodiment, female receiving region 210 extends from lateral side 206 into at least some of at least one element 700. That is, female receiving region 210 can have a depth as deep as at least some of only one element or can extend further into first flooring panel 200.

Figure 8A:
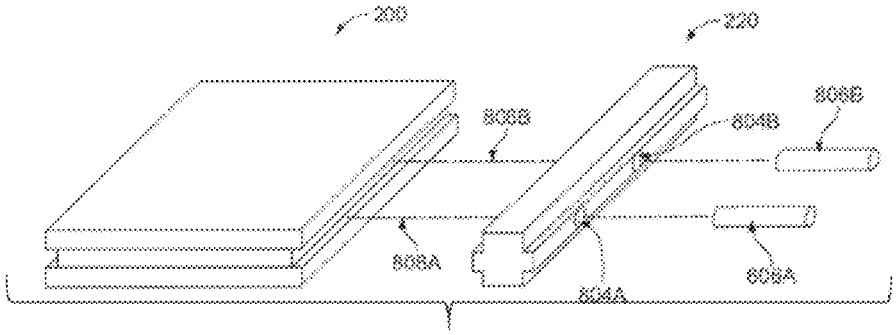
FIGS. 8A-8B illustratively depict the first and second flooring panel including a retention element of the system and method of the present invention.
Figure 8B:
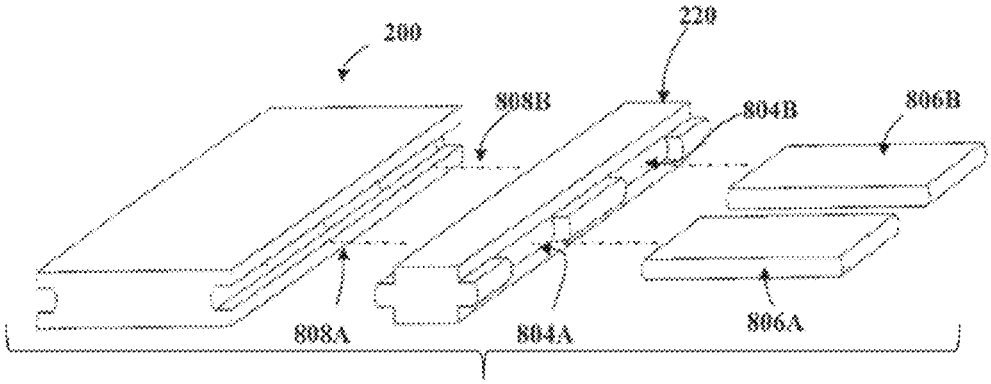

Referring to FIGS. 8A-8C and FIGS. 2C-2K, in accordance with an exemplary embodiment, first flooring panel 200 can include at least one retention element receiving opening (not shown) and second flooring panel 220 can include at least one retention element receiving opening 804 (e.g., 804A, 804B) and are illustratively depicted with at least one retention element 806 (e.g., 806A, 806B). Referring to FIGS. 8A-8B, at least one retention element 806 can follow a path 808 (e.g., 808A, 808B) through retention element receiving opening 804 in second flooring panel 220 and continue a desired depth into retention element opening 802 in first flooring panel 200.

As shown, the at least one retention element receiving openings can cause the male protrusion to be discontinuous along the length of the second flooring panel.

Figure 8C:
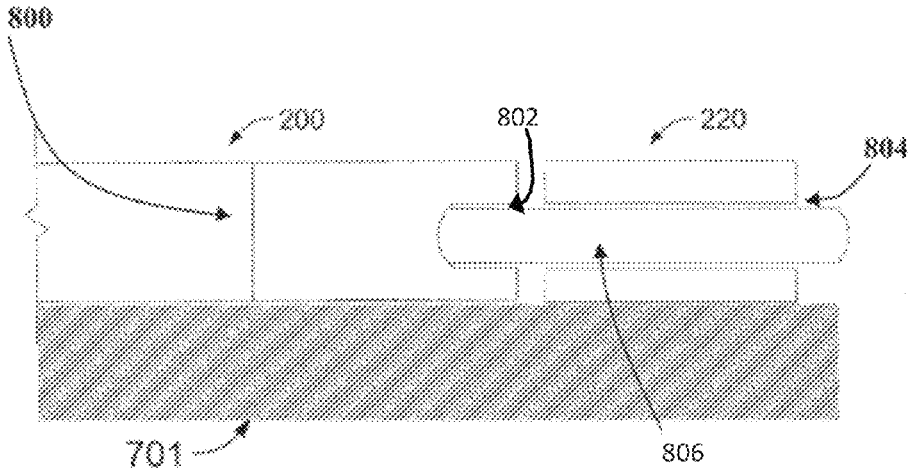
FIG. 8C illustratively depicts a bisected view of the first and second flooring panel while mated together including a retention element of the system and method of the present invention.
Figure 8D:
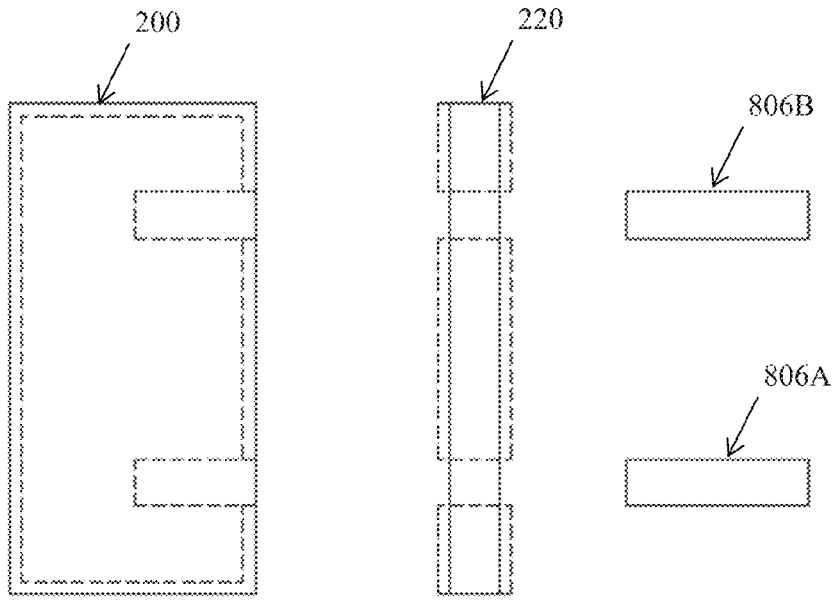
Figure 8E:
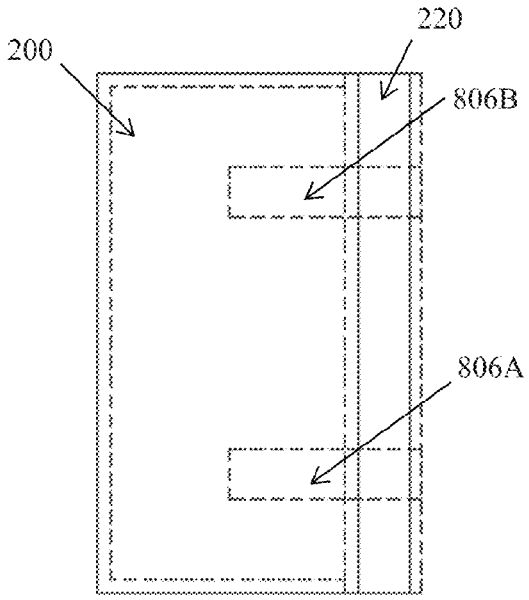

Referring to FIG. 8C, in accordance with an exemplary embodiment, retention element receiving opening 802 in first flooring panel 200 can extend a depth of at least partially into at least one element 800 and retention receiving opening 804 in second flooring panel 220 can extend from a first lateral side to a second lateral side. That is, retention element 806 can be placed through retention receiving opening 804 and in second flooring panel 220 and into retention element receiving opening 802 in first flooring panel 200 such that retention element 806 can be located in both first flooring panel 200 and second flooring panel 220. Retention element 806 can hold together first flooring panel 200 to second flooring panel 220 lessening the chances of having either panel move up or down. In other words, retention element 806 can assist in maintaining a flush surface for a floor including a combination of first flooring panel 200 and second flooring panel 220.

In accordance with an exemplary embodiment, retention element 806 can include a substantially monolithic material extending between a first end and a second end having a substantially smooth outer surface. Retention element 806 can be a substantially solid wood material, similar to those described above, or can be a metallic material. Further, retention element 800 can include geometric variations on its outer surface such as, but not limited to, a thread pattern, ribbed pattern, swirl pattern, or any other reasonable geometric variation. Further still, retention element 806 can have any reasonable shape, such as, but not limited to a rectangular cuboid, square cuboid, trapezohedron, round columnar shape, square columnar shape, oval columnar shape, hexagonal columnar shape, star columnar shape, triangular columnar shape, rectangular columnar shape, or any other reasonable shape. See FIGS. 8A-8K.

Figure 9A:
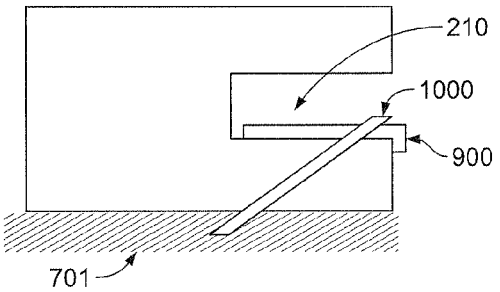
FIGS. 9A-9C illustratively depict a bisected view of the first panel including an insert having a guide and/or staple of the system and method of the present invention.
Figure 9B:
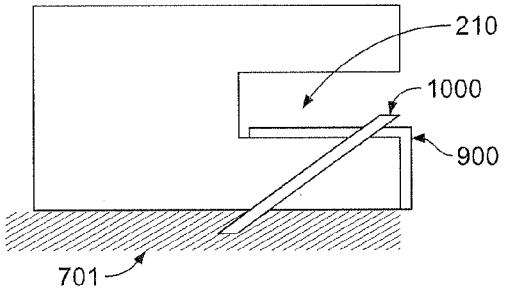
Figure 9C:
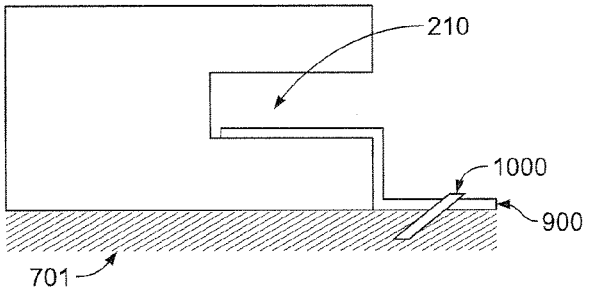
Figure 10A:
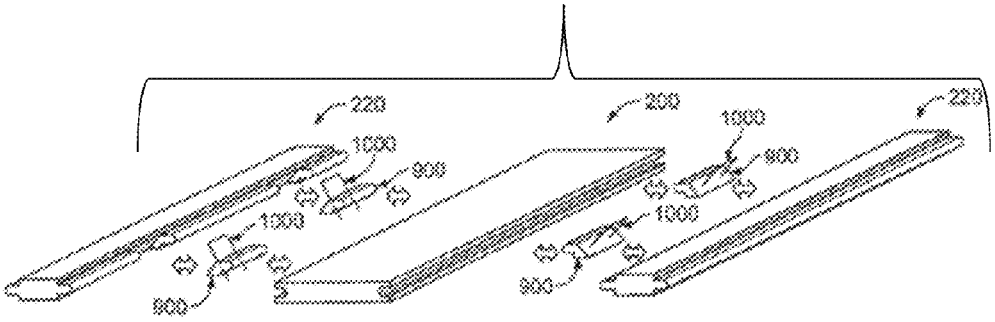
FIGS. 10A-10L illustratively depict inserts of the system and method of the present invention.
Figure 10B:
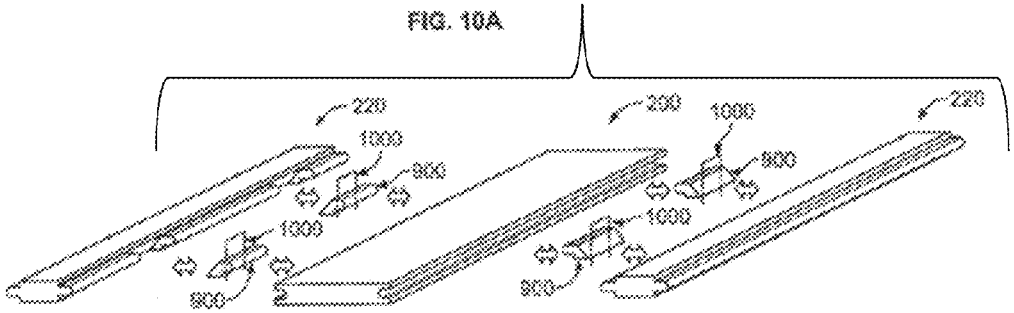
Figure 10C:
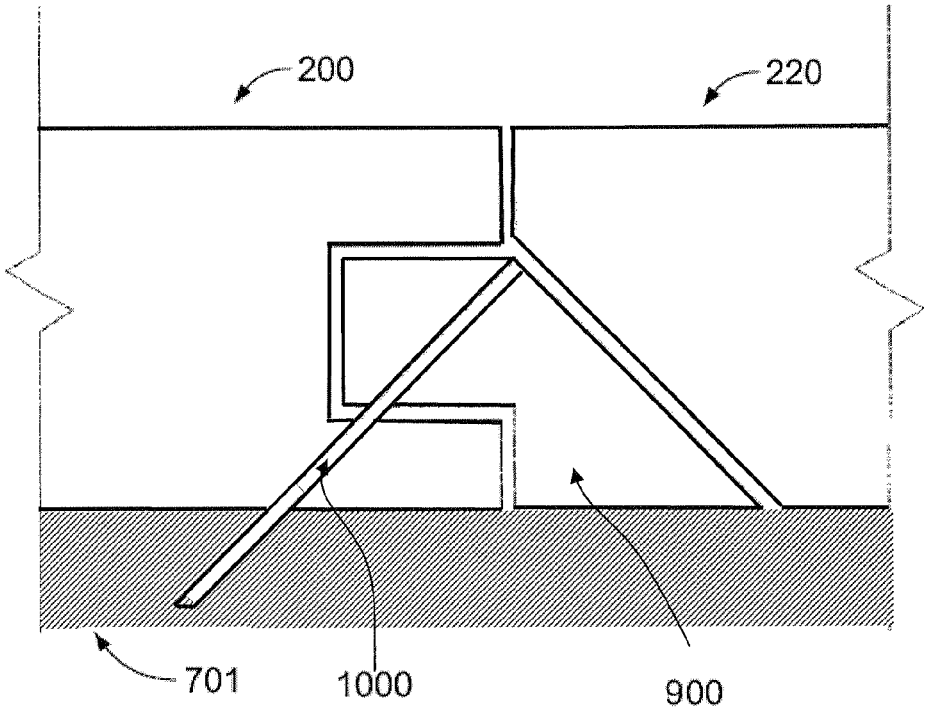
Figure 10F:
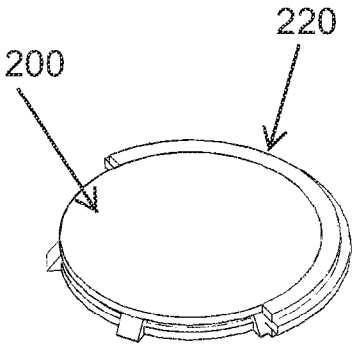
Figure 10E:
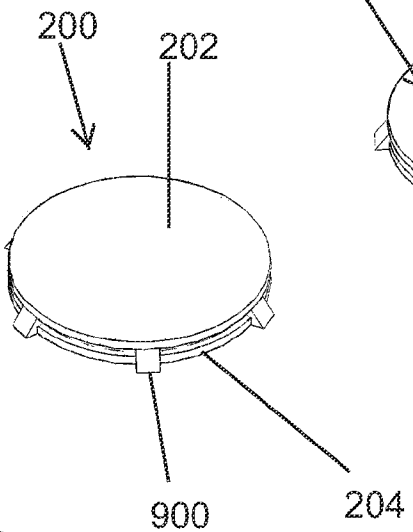
Figure 10D:
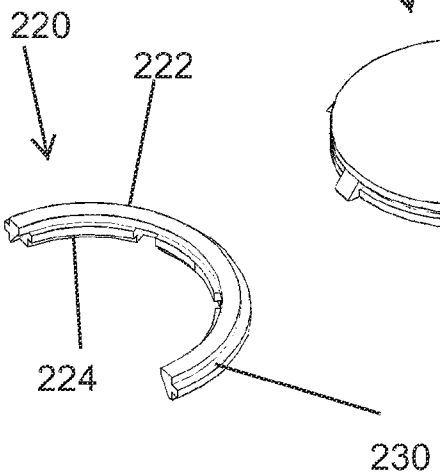
Figure 10D:
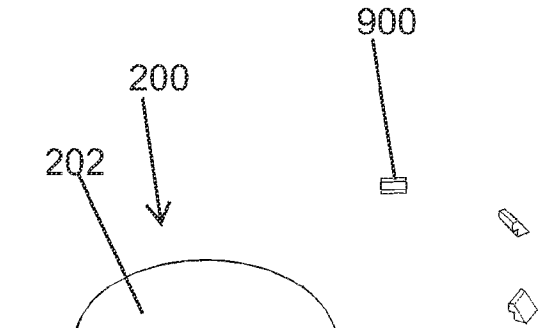
Figures 10G, 10H, 10I:
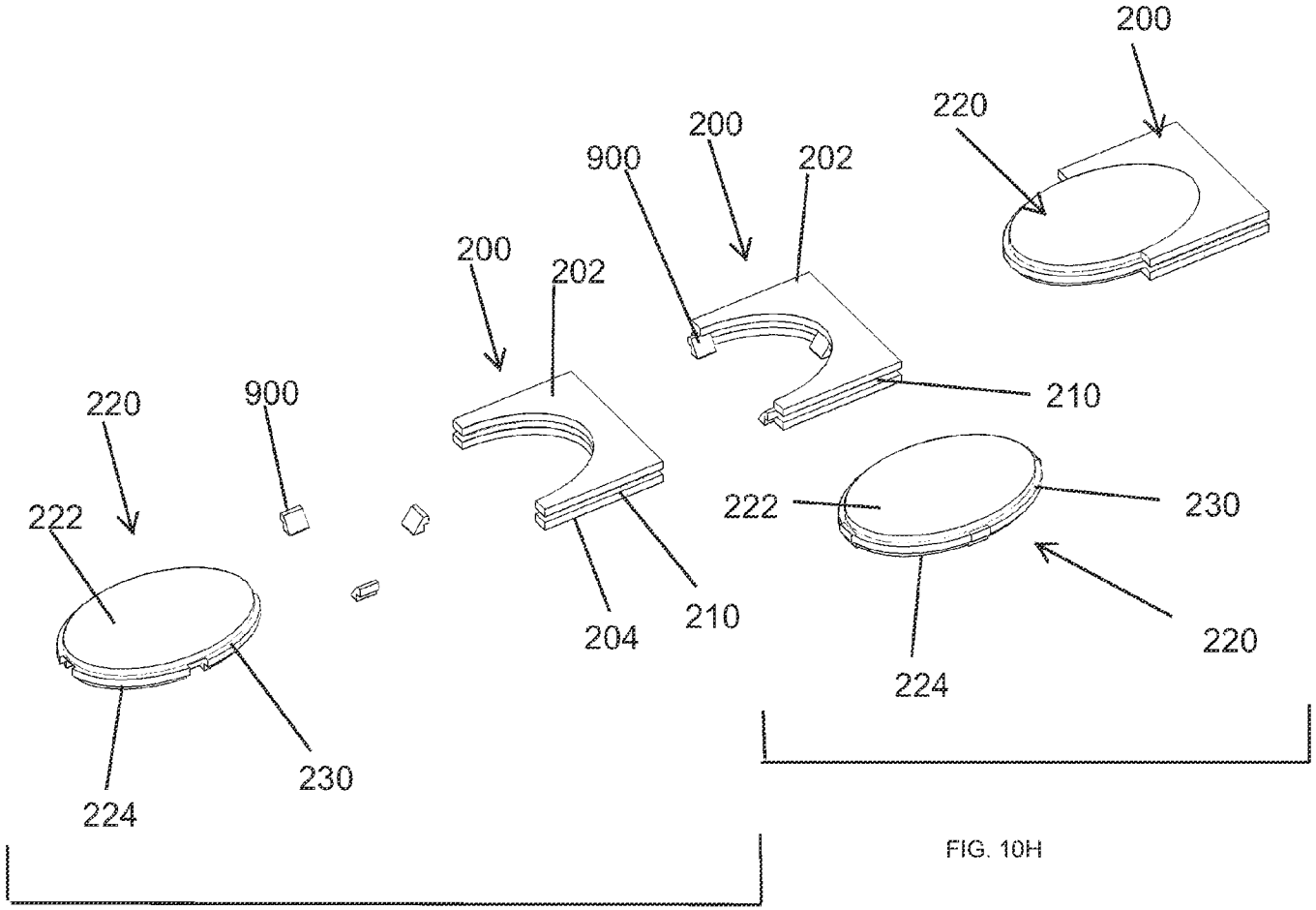
Figures 10J, 10K, 10L:
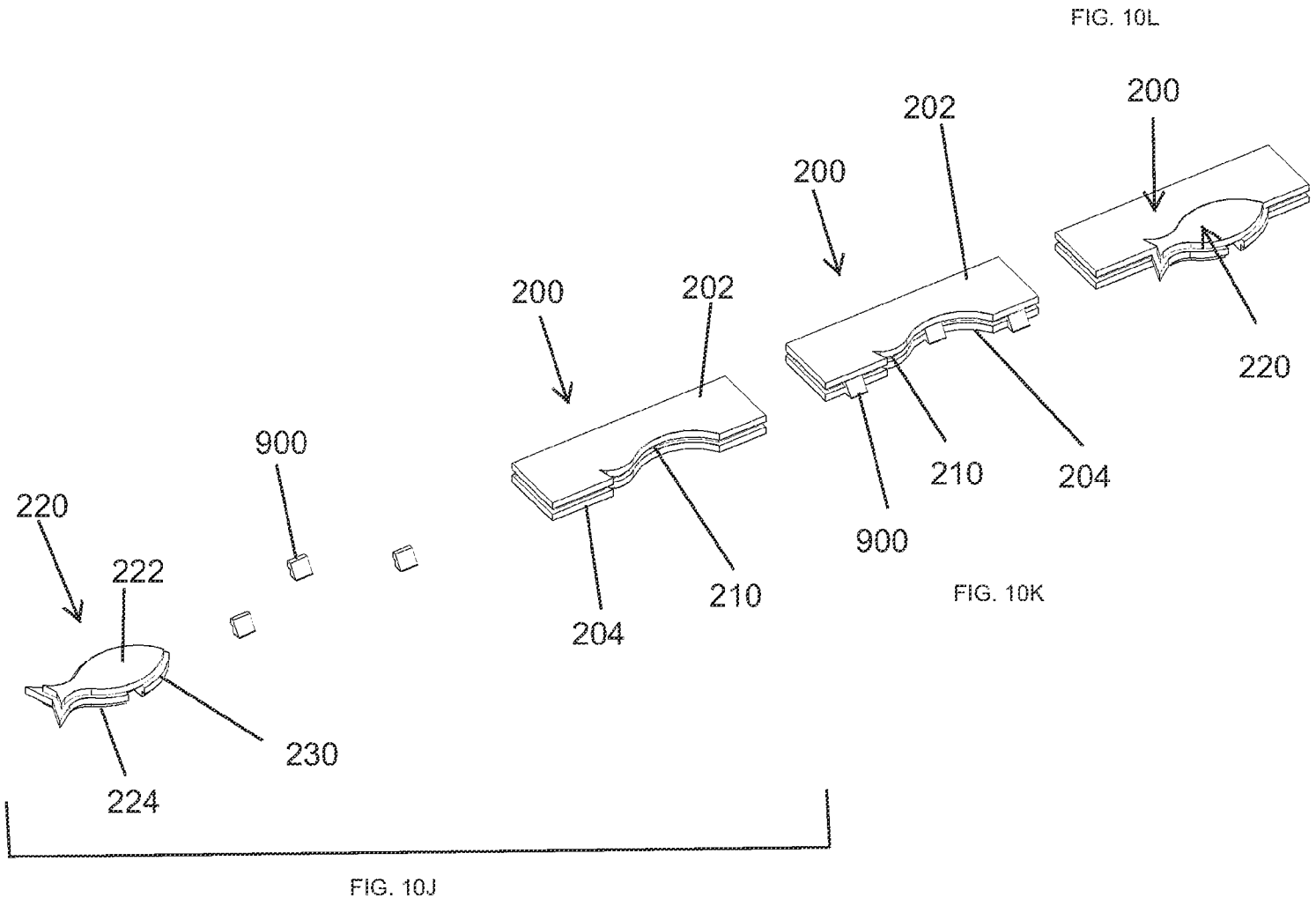
Figure 11A:
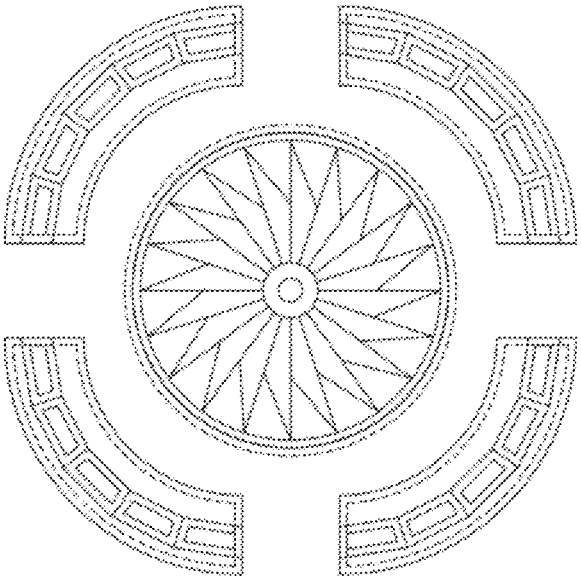
Figure 11B:
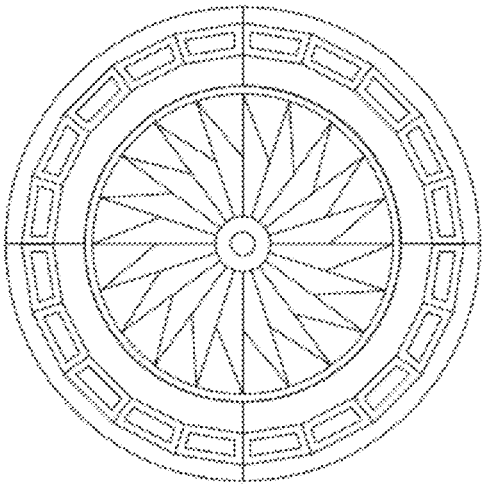
Figure 12:
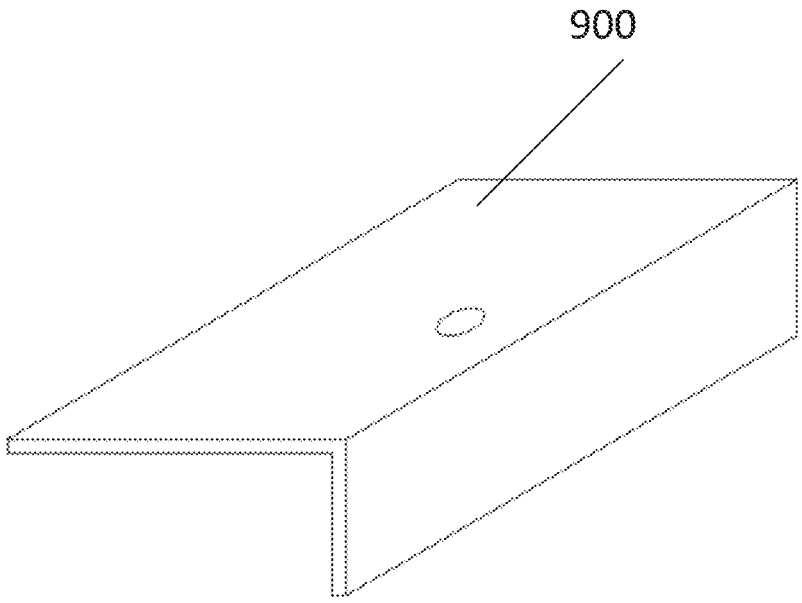
Figure 13A:
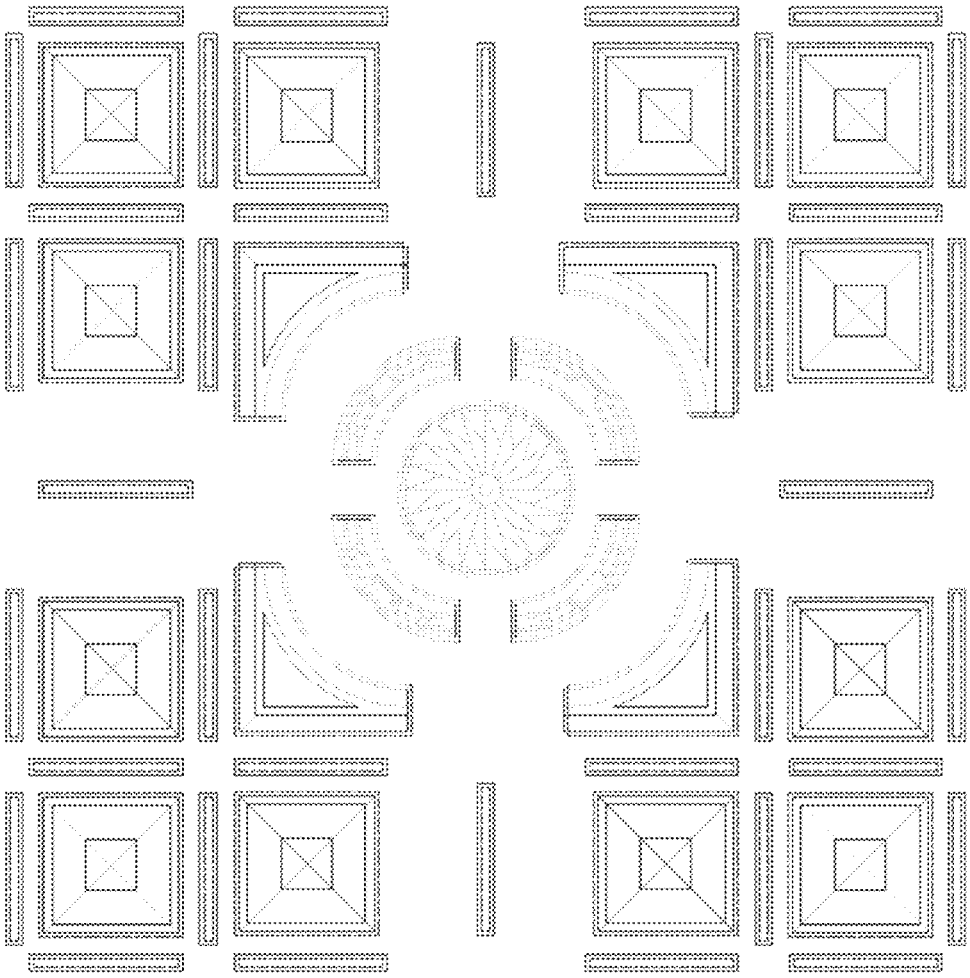
Figure 13B:
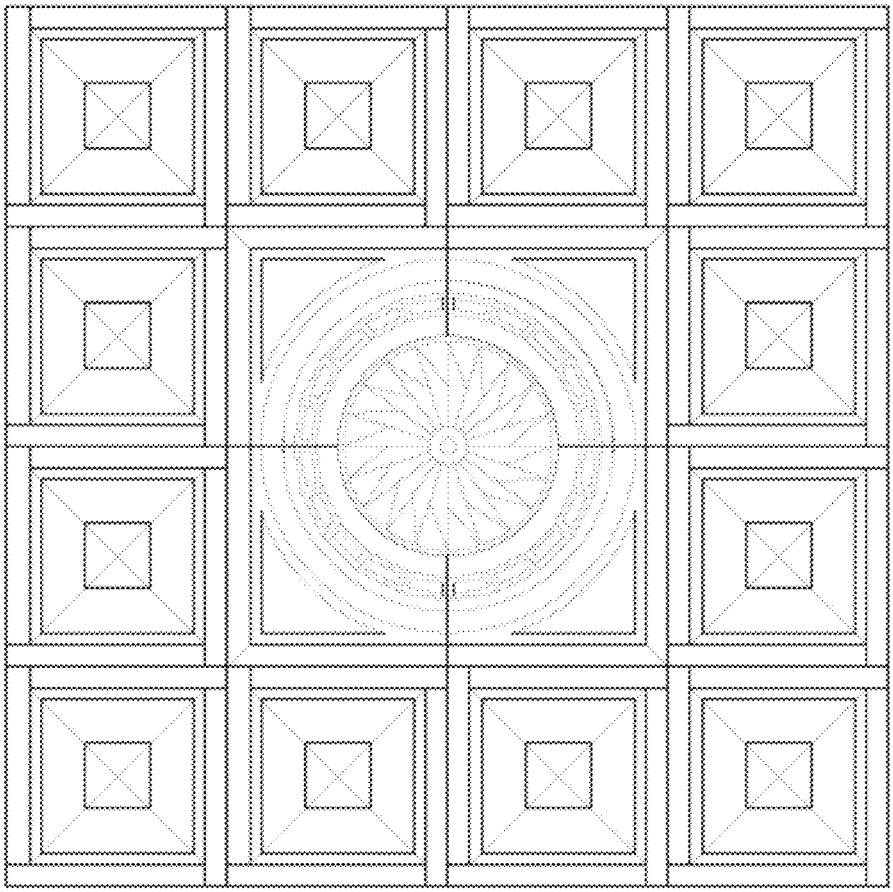

Referring to FIGS. 9A-9C, in accordance with an exemplary embodiment, an insert 900 can be placed in either of female receiving region 210 or on male protrusion 230 (not shown). Insert 900 can be designed to contour the geometric shape of either, or both, female receiving region 210 and male protrusion 230. Insert 900 can protect either, or both, female receiving region 210 and male protrusion 230.

Referring to FIGS. 9A-9B, in accordance with an exemplary embodiment, a staple and/or nail 1000 can pass through insert 900 and through first flooring panel 200. In accordance with an exemplary embodiment, insert 900 can include a guide (e.g., an opening, dimple, recess, etc.) guiding staple and/or nail 1000 through insert 900. Staple and/or nail 1000 can further pass into at least a portion of subfloor 701. For example, staple and/or nail 1000 can be placed into subfloor 701 at an angle of about 45° to subfloor 701. Insert 900 can be used to redistribute the force applied by a staple and/or nail driven into subfloor 701. This redistribution of force can, for example, protect female receiving region 210 from damage as well as assists in maintaining a flush surface for a floor including a combination.

Referring to FIG. 9C, in accordance with an exemplary embodiment, staple and/or nail 1000 can pass through insert 900 and into subfloor 701 while not passing through first flooring panel 200. For example, staple and/or nail 1000 can be placed into subfloor 701 at an angle of about 45° to subfloor 701, perpendicular to subfloor 701, or at any reasonable angle. In accordance with an exemplary embodiment, insert 900 can include a guide (e.g., an opening, dimple, recess, etc.) for guiding staple and/or nail 1000 through insert 900.

Referring to FIGS. 10A-10L, in accordance with an exemplary embodiment, an insert 900 can replace a region of panel 220 such that insert 900 includes a protrusion that can fit into the female receiving region of panel 200. That is, panel 220, can include a region that is cut out in a shape that will mate with insert 900 when inset 900 is inserted into the receiving region of panel 200. These regions which are cut out can result in a discontinuous male protrusion extending the length of panel 220. In some embodiments, when the protrusion of insert 900 is located in the groove of panel 200, staple and/or nail 1000 can be placed through insert 900 and into the subfloor thereby affixing panel 200 to the subfloor. Further, staple and/or nail 1000 can pass through insert 900 at an angle and can pass through insert 900, panel 200, and into the subfloor or can pass through insert 900 and into the subfloor. In some embodiments, insert 900 can be shaped substantially similar to the region of panel 220 that is replaced by insert 900 such that after insert 900 is coupled to panel 200, panel 220 can be attached to panel 200.

Now that exemplary embodiments of the present invention have been shown and described in detail, various modifications and improvements thereon will become readily apparent to those skilled in the art.

What is claimed is:

1. A flooring system, comprising:

a set of first flooring panels having a first shape including a top surface, a bottom surface, and at least one side, each of the first flooring panels including at least one groove extending at least partially the length of the at least one side, and each of the first flooring panels being constructed from a plurality of substantially monolithic solid wood elements adhesively affixed together, at least one of the plurality of monolithic solid wood elements having a circular or oval shape, wherein the first shape is selected from the group of circular shape, ovoid shape, and closed-curved shape;

a set of second flooring panels having a second shape different than the first shape, including a top surface, a bottom surface, and at least one side, each of the second flooring panels including at least one tongue extending at least partially the length of the at least one side, and each of the second flooring panels being constructed of at least one substantially monolithic solid wood element, wherein the second shape contains a recess corresponding to at least a portion of the first flooring panels;

the first flooring panels and the second flooring panels being connected such that the tongues of the second flooring panels are inserted into the grooves of the first flooring panels; and the resulting connection between the flooring panels forming a floor with substantially flush upper surface.

2. The system of claim 1, wherein the groove of the first flooring panels at least partially extend on two or more sides of the first flooring panels and the tongue of the second flooring panels at least partially extend on two or more sides of the second flooring panels.

3. The system of claim 1, wherein the groove of the first flooring panels at least partially extend on all sides of first flooring panels and the tongue of the second flooring panels at least partially extend on all sides of the second flooring panels.

4. The system of claim 1, wherein the first flooring panels comprise a plurality of pieces of material forming a decorative mosaic design on the upper surface of the floor.

5. The system of claim 1, further comprising:

a protective insert shaped to correspond to the contour of the groove of the first flooring panels, the insert being located in the groove of the first flooring panels.

6. The system of claim 5, wherein the insert includes a guide capable of having at least one nail or staple placed through a lower region of the groove of the first flooring panels and into a base structure.

7. The system of claim 6, wherein the guide is oriented at about a 45 degree angle from vertical.

8. The system of claim 5, wherein the insert includes a guide capable of having at least one nail or staple placed through it and into a base structure.

9. The system of claim 1, wherein the tongue of second flooring panels discontinuously extends at least partially the length of at least one side of the second flooring panels such that the length of the side includes at least one tongued region and at least one non-tongued region.

10. The system of claim 9, further comprising an insert having a non-tongued region shaped to the contour of the non-tongued region of the second flooring panels and a tongued region.

11. The system of claim 10, wherein the non-tongued region of the insert includes a sloped surface and the non-tongued region of the second flooring panels includes a similarly sloped surface.

12. The system of claim 10, wherein the tongued region of the insert is capable of being inserted into the groove of the first flooring panels and is capable of receiving an at least one nail or staple such that the insert is substantially affixed to a base structure.

13. The system of claim 12, wherein the insert is capable of receiving the at least one nail or staple such that the nail or staple passes through the insert, through a region of the groove of the first flooring panel, and into the base structure.

14. The system of claim 13, wherein when the insert is affixed to the base structure the non-tongued region of the second flooring panel is capable of being mated with the non-tongued region of the insert.

15. The system of claim 12, wherein the insert is capable of receiving the at least one nail or staple such that the nail or staple passes through the insert and into the base structure.

16. The system of claim 9, further comprising:

a retention element substantially maintaining the flooring panels flush upper surface;

the first flooring panels including at least one retention element receiving opening, the retention element receiving opening being on at least one side of the first flooring panels and creating an opening extending a predetermined depth into the body the first flooring panel;

the second flooring panels including at least one retention element receiving opening located on at least one of the tongued region and the non-tongued region of the second flooring panel, the retention element receiving opening extending through the body of the second flooring panel;

wherein the retention element is inserted into the receiving opening in the second flooring panel and placed through the second flooring panel and inserted into the receiving opening in the first flooring panel and inserted at least partially into the first flooring panel; and wherein at least some of the retention element remains in both the first and second flooring panels.

17. The system of claim 16, wherein when the retention element remains in both the first and second flooring panels, a region of the retention element remains substantially flush with the tongue of the second flooring panel.

18. The system of claim 16, wherein the retention element is further comprising:

a first end, a second end, and a substantially monolithic body connecting the first end to the second end; and the monolithic body has an external surface.

19. The system of claim 18, wherein the external surface of the retention element is at least one of substantially smooth and contains a geometric shape designed to mate with the receiving opening in the first and second flooring panels.

20. The system of claim 18, wherein the ends of the retention element are at least one of substantially triangular, square, polygonal, hexagonal, circular, oval, and rectangular.

21. The system of claim 16, wherein the height of the retention element is substantially similar to the height of the tongue of the second flooring panels and the retention element includes a substantially flat upper and lower surface.

22. The system of claim 1, wherein for each of the first flooring panels, the plurality of substantially monolithic solid wood elements adhesively affixed together have at least two different shapes.

23. The system of claim 22, wherein for each of the first flooring panels, at least one of the plurality of substantially monolithic solid wood elements adhesively affixed together has a circular shape.

24. The system of claim 22, wherein for each of the first flooring panels, at least one of the plurality of substantially monolithic solid wood elements adhesively affixed together has an oval shape.

25. The system of claim 22, wherein for each of the first flooring panels, at least one of the plurality of substantially monolithic solid wood elements adhesively affixed together has a curved shape.

* * * * *